US008452519B2

(12) United States Patent
Kokubo et al.

(10) Patent No.: US 8,452,519 B2
(45) Date of Patent: May 28, 2013

(54) VALVE TIMING CONTROL APPARATUS FOR INTERNAL COMBUSTION ENGINE

(75) Inventors: Naoki Kokubo, Hiratsuka (JP); Yoshiyuki Kobayashi, Atsugi (JP); Masahiko Watanabe, Yokohama (JP); Takahumi Oowada, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 1046 days.

(21) Appl. No.: 12/372,227

(22) Filed: Feb. 17, 2009

(65) Prior Publication Data

US 2009/0210137 A1 Aug. 20, 2009

(30) Foreign Application Priority Data

Feb. 19, 2008 (JP) ..... 2008-037061

(51) Int. Cl.
*F02D 45/00* (2006.01)
*F01L 1/34* (2006.01)

(52) U.S. Cl.
USPC ..... 701/103; 123/90.15

(58) Field of Classification Search
USPC ..... 701/101–105, 112–115; 123/90.1, 123/90.15–90.17, 90.21–90.24, 90.31, 321, 123/322
See application file for complete search history.

(56) References Cited

U.S. PATENT DOCUMENTS 6,708,657 B2 * 3/2004 Iwaki et al. ..... 123/90.17
7,181,330 B2 * 2/2007 Shimojo et al. ..... 701/102
7,191,746 B2 * 3/2007 Nakamura ..... 123/179.3
7,441,524 B2 10/2008 Okamoto et al.
2003/0000489 A1 * 1/2003 Majima et al. ..... 123/90.17
2004/0010363 A1 * 1/2004 Watanuki et al. ..... 701/114
2006/0207536 A1 * 9/2006 Todo et al. ..... 123/90.16
2006/0229797 A1 * 10/2006 Sawada et al. ..... 701/114
2006/0231052 A1 * 10/2006 Yamanaka ..... 123/90.17
2007/0221151 A1 * 9/2007 Kadowaki ..... 123/90.17
2008/0017149 A1 * 1/2008 Kokubo et al. ..... 123/90.16
2008/0288155 A1 * 11/2008 Watanabe et al. ..... 701/102
2009/0007862 A1 * 1/2009 Nakamura et al. ..... 123/90.12
2009/0007865 A1 * 1/2009 Nguyen et al. ..... 123/90.15
2009/0018754 A1 * 1/2009 Hano et al. ..... 701/103
2009/0125216 A1 * 5/2009 Watanabe et al. ..... 701/105
2009/0183701 A1 * 7/2009 Nguyen et al. ..... 123/90.15

FOREIGN PATENT DOCUMENTS

JP 2005-299640 A 10/2005

* cited by examiner

*Primary Examiner* — John T. Kwon
*Assistant Examiner* — Johnny Hoang
(74) *Attorney, Agent, or Firm* — Foley & Lardner LLP

(57) ABSTRACT

A valve timing control apparatus includes a phase varying mechanism arranged to vary a relative rotational phase of a cam shaft with respect to a crank shaft; a driving mechanism arranged to provide a driving force to the phase varying mechanism by energization; a control mechanism configured to control a current applied to the driving mechanism; and a phase angle sensing mechanism arranged to sense the relative rotational phase of the cam shaft with respect to the crank shaft, and to have a detection period longer than a control period of the control mechanism in accordance with an engine operating state. The control mechanism is configured to repeat increasing and decreasing of the current applied to the driving mechanism when the phase varying mechanism continuously varies the relative rotational phase of the cam shaft with respect to the crank shaft by a predetermined angle or more.

21 Claims, 10 Drawing Sheets

VALVE TIMING CONTROL APPARATUS FOR INTERNAL COMBUSTION ENGINE

BACKGROUND OF THE INVENTION

This invention relates to a valve timing control apparatus configured to vary a relative rotational phase of a cam shaft with respect to a crank shaft of an internal combustion engine, and to vary a valve timing (opening and closing timing) of an intake valve or an exhaust valve.

U.S. Pat. No. 7,441,524 (corresponding to Japanese Patent Application Publication No. 2005-299640) shows a valve timing control apparatus including a rotational phase sensing section configured to sense a relative rotational phase between a crank shaft and a cam shaft at an arbitrary timing. This valve timing control apparatus is controlled by the rotational phase sensed by the rotational phase sensing section.

This valve timing control apparatus can sense the relative rotational phase even in a period shorter than a rotation period of the cam shaft. The feedback control of the valve timing control can be performed even at the low rotation speed so as to correspond the control period of the valve timing to the detection period of the relative rotational phase. Accordingly, it is possible to attain the high-responsive/high-accurate valve timing control.

That is, in a case in which there is roughness of the detection period of the rotational phase sensing section irrespective of the engine rotation, the phase is separated from the target phase by the overshoot after the arrival to the target phase angle, so that it is adversely affected. Accordingly, the rotational phase sensing section with the high accuracy is used so as to suppress the overshoot, and to improve the control response and the control accuracy.

SUMMARY OF THE INVENTION

However, the valve timing control apparatus has a common characteristic to have deteriorated controllability for response delay of actuator and a large sliding resistance immediately after the start of the operation, and to thereby tend to cause the overshoot. Moreover, in the conventional valve timing control apparatus, the expensive rotational phase sensing section is used for suppressing the overshoot caused by the roughness of the detection period of the rotational phase sensing section. Consequently, the cost is increased.

It is, therefore, an object of the present invention to provide a valve timing control apparatus (VTC) devised to suppress the overshooting at the operation of the valve timing control apparatus, and to decrease the cost.

According to one aspect of the present invention, a valve timing control apparatus for an internal combustion engine which is configured to control an opening timing or a closing timing of an intake valve or an exhaust valve, the valve timing control apparatus comprises: a phase varying mechanism arranged to vary a relative rotational phase of a cam shaft with respect to a crank shaft; a driving mechanism arranged to provide a driving force to the phase varying mechanism by energization; a control mechanism configured to control a current applied to the driving mechanism; and a phase angle sensing mechanism arranged to sense the relative rotational phase of the cam shaft with respect to the crank shaft, and to have a detection period longer than a control period of the control mechanism in accordance with an engine operating state, the control mechanism configured to repeat increasing and decreasing of the current applied to the driving mechanism when the phase varying mechanism continuously varies the relative rotational phase of the cam shaft with respect to the crank shaft by a predetermined angle or more.

According to another aspect of the invention, a valve timing control apparatus for an internal combustion engine which is configured to control an opening timing or a closing timing of an intake valve or an exhaust valve, the valve timing control apparatus comprises: a phase varying mechanism arranged to vary a relative rotational phase of a cam shaft with respect to a crank shaft; a driving mechanism arranged to provide a driving force to the phase varying mechanism by energization; a control mechanism configured to perform a duty control of a current applied to the driving mechanism; and a phase angle sensing mechanism arranged to sense the relative rotational phase of the cam shaft with respect to the crank shaft, and to have a detection period longer than a control period of the control mechanism in accordance with an engine operating state, the control mechanism configured to repeat increasing and decreasing of a duty ratio for the driving mechanism when the phase varying mechanism continuously varies the relative rotational phase of the cam shaft with respect to the crank shaft by a predetermined angle or more.

According to still another aspect of the invention, a valve timing control apparatus for an internal combustion engine which is configured to control an opening timing or a closing timing of an intake valve or an exhaust valve, the valve timing control apparatus comprises: a phase varying mechanism arranged to vary a relative rotational phase of a cam shaft with respect to a crank shaft; a driving mechanism arranged to provide a driving force to the phase varying mechanism by energization; a control mechanism configured to control a current applied to the driving mechanism; and a phase angle sensing mechanism arranged to sense the relative rotational phase of the cam shaft with respect to the crank shaft, and to have a detection period longer than a control period of the control mechanism in accordance with an engine operating state, the phase varying mechanism arranged to repeat increasing and decreasing of a movement speed when the phase varying mechanism continuously varies the relative rotational phase of the cam shaft with respect to the crank shaft by a predetermined angle or more.

DETAILED DESCRIPTION OF THE INVENTION

Hereinafter, a valve timing control apparatus of an internal combustion engine according to embodiments of the present invention will be illustrated with reference to the drawings.

In these embodiments described later, the present invention is applied to a valve actuating apparatus on the intake side of an inline four cylinder engine. A structure of the cylinder is not limited to this structure.

Figure 1:
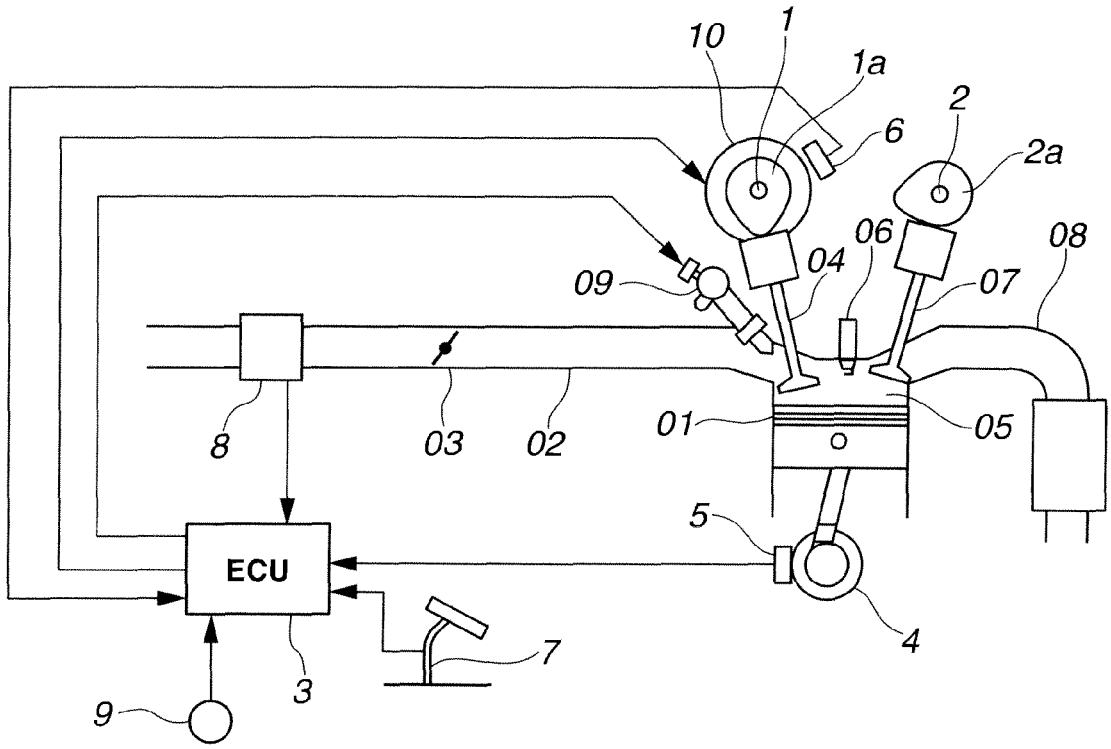
FIG. 1 is a schematic view showing an engine employing a valve timing control apparatus according to a first embodiment of the present invention.

FIG. 1 is a schematic view showing the entirety of the internal combustion engine. An intake passage 02 is formed within an engine body 01 including a cylinder block and a cylinder head. A throttle valve 03 is formed within intake passage 02. The air is sucked through throttle valve 03 and an intake valve 04 into a combustion chamber 05. A spark plug 06 for the ignition of the air-fuel mixture is provided within combustion chamber 05. The exhaust gas flows through an exhaust valve 07 into an exhaust passage 08. The exhaust gas is purified by a catalyst mounted to exhaust passage 08, and discharged to the atmosphere.

Intake valve 04 and exhaust valve 07 are controlled to open and close by spring force of valve springs (not shown) and driving cams 1*a* and 2*a* provided to an intake cam shaft 1 and an exhaust cam shaft 2.

A fuel injector 09 is provided to the intake port of each cylinder, and controlled by an engine control unit (ECU) 3 to inject fuel toward intake valve 04.

ECU 3 controls actuators provided to the vehicle, by calculation results based on inputted detection signals of sensors.

There are provided a crank angle sensor 5 arranged to sense a reference crank angle signal REF in reference rotation positions at intervals of the rotational angle of 180 degrees of crank shaft 4, and to sense a unit angle signal POS; a cam angle sensor 6 arranged to sense a cam signal CAM in the reference rotation positions at intervals of the cam angle of 90 degrees (the crank angle of 180 degrees); an accelerator opening sensor 7 arranged to sense an accelerator opening APS; an air flow meter 8 arranged to sense an intake air quantity Qa of the engine; and a cooling water temperature sensor 9 arranged to sense a cooling water temperature Tw. An engine speed Ne is calculated based on a period of reference crank angle signal REF, or frequency of the detection of unit angle signal POS per unit time.

Moreover, a valve timing control apparatus (VTC) 10 is provided at an one end portion of an intake cam shaft 1.

Figure 2:
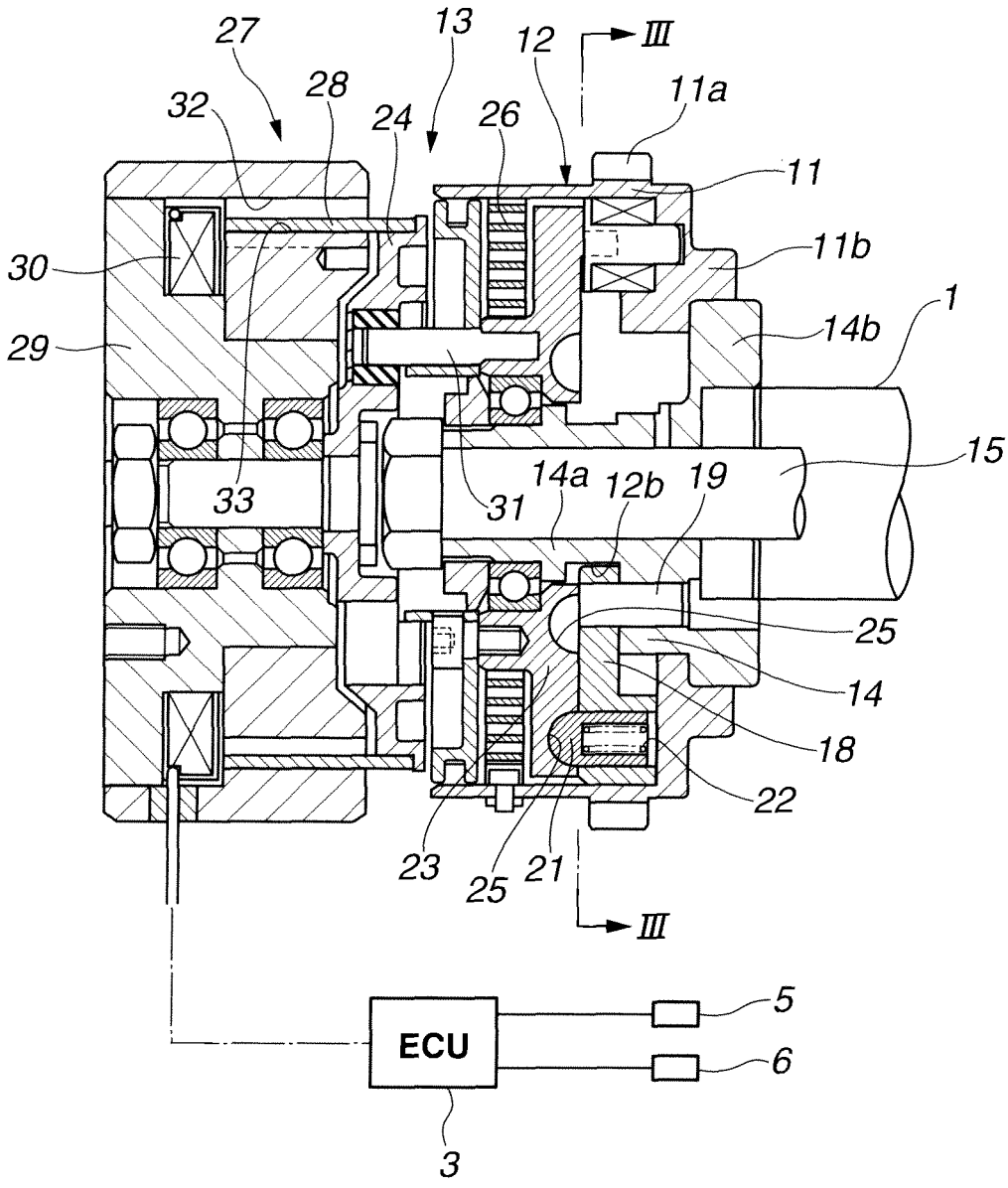
FIG. 2 is a sectional view showing the valve timing control apparatus of FIG. 1.
Figure 3:
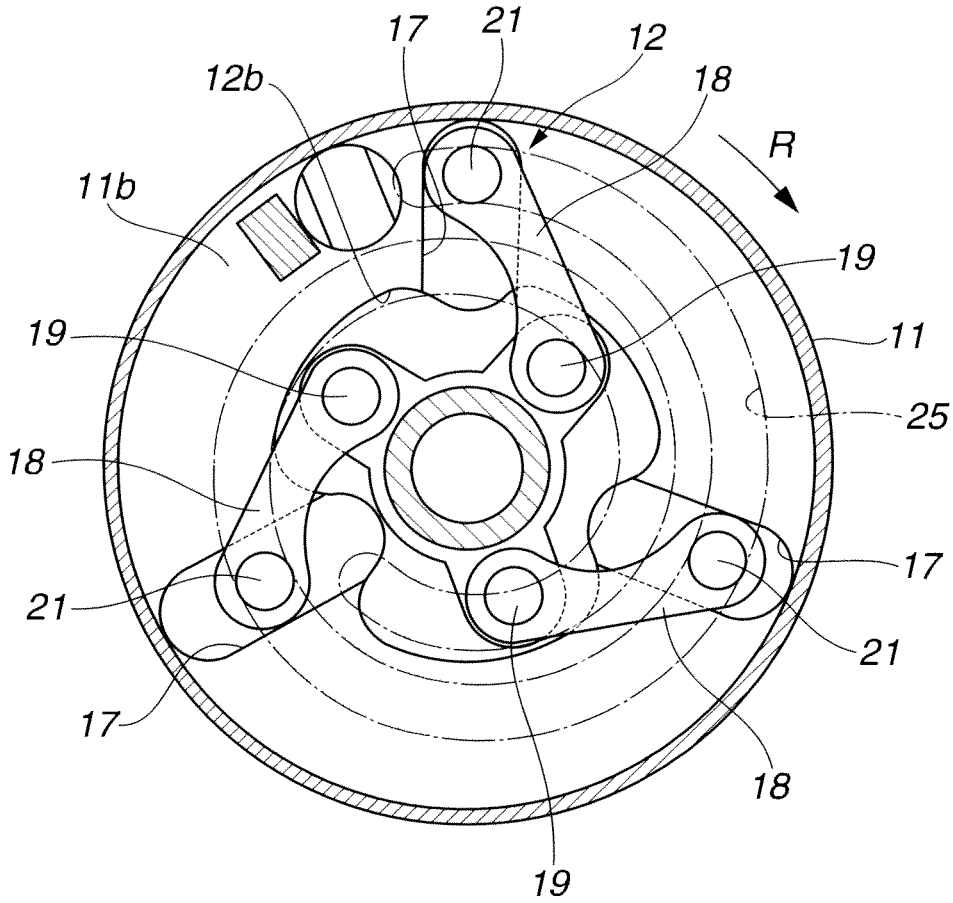
FIG. 3 is a sectional view taken along a section line III-III of FIG. 2.

As shown in FIGS. 2 and 3, this VTC 10 includes intake cam shaft 1; a timing sprocket 11 which is a driving rotational member provided at a front end portion of this intake cam shaft 1, and arranged to be relatively pivoted; a phase varying mechanism 12 disposed radially inside timing sprocket 11, and arranged to vary a relative rotational phase between intake cam shaft 1 and timing sprocket 11; an electromagnetic brake mechanism 13 which is a driving mechanism arranged to provide a driving force to phase varying mechanism 12 by the energization; a crank angle sensor 5 and a cam angle sensor 6 which are phase angle sensing mechanisms arranged to sense relative rotational phase between timing sprocket 11 and cam shaft 1.

Cam shaft 1 includes two cams 1*a* and 1*a* provided to each cylinder, disposed on an outer surface of cam shaft 1, and arranged to open intake valve 04. A driven shaft member 14 is connected with an end portion of cam shaft 1 in the axial direction by a cam bolt 15.

Driven shaft member 14 includes a cylindrical shaft portion 14*a* having a through hole into which cam bolt 15 is inserted; and a larger diameter portion 14*b* which is a flange shape with a larger diameter, and which is formed integrally with an end portion of shaft portion 14*a* on the cam shaft 1's side. A plurality of guide holes 14*c* are formed on an outer surface of shaft portion 14*a* on the larger diameter portion 14*b*'s side.

Timing sprocket 11 includes a gear 11*a* which is a ring shape, which is formed integrally on an outer circumference of timing sprocket 11, and which is connected through a timing chain (not shown) with the crank shaft 4; and a driving ring 11*b* which is a substantially circular plate, which is provided radially inside this ring-shaped gear 11*a*, and which includes an inner circumference surface of a through hole formed at a substantially central portion of driving ring 11*b*, and rotatably supported on an outer circumference of larger diameter portion 14*b* of driven shaft member 14.

Driving ring 11*b* includes three radial window holes 17 which are radial guides, each of which passes through driving ring 11*b*, and each of which extends in the substantially radial direction of timing sprocket 11. Each of radial window holes 17 has side walls confronting each other, and extending in parallel with each other. There are provided three link members 18 each provided between adjacent two of radial window holes 17, each inserted into one of radial window holes 17, and each arranged to be moved in the circumferential direction.

Each of link members 18 is bent into a substantially arc shape. Each of link members 18 includes a first end portion which is a cylindrical shape, and a second end portion which is a cylindrical shape. Three lever protrusions are integrally formed on an inner circumference of an end portion of the larger diameter portion 14*b* of driven shaft member 14 to protrude. One end portion of each pin 19 is inserted into and fixed on, by the press fit, a holding hole penetrating through one of the lever protrusions. The first end portion of link member 18 is rotatably connected with the other end portion of pin 19.

The second end portion of each link member 18 is inserted into one of radial window holes 17, and has a receiving hole opened axially in the forward direction. The receiving hole of each link member 18 receives, through one of radial window holes 17, an engagement pin 21 having a spherical end portion engaged with a spiral groove 25 of a spiral disc 23 described later, and a coil spring 22 arranged to urge this engagement pin 21 in the forward direction (on the spiral groove 25's side).

The first end portion of each link member 18 is connected through pin 19 with driven shaft member 14 in a state in which the second end of link member 18 is inserted into the corresponding radial window hole 17. Accordingly, the first end portion of each link member 18 is moved along the one of guide holes 14*c* when link member 18 is moved along each radial window hole 17 by the external force, so that timing sprocket 11 and driven shaft member 14 are relatively pivoted in a direction and angle which correspond to the displacement of the second end portion.

Spiral disc 23 is rotatably supported through a bearing on an outer circumference of shaft portion 14*a*, on the forward side of driving ring 11*b*. This spiral disc 23 includes an inner circumference portion slidably supported on the outer circumference surface of shaft portion 14*a*; and a disc portion located radially outside of the inner circumference portion. One spiral groove 25 is formed on a rear surface of the disc portion of spiral disc 23 on the cam shaft 1's side. Spiral groove 25 has a semicircular section, and is a spiral guide. The end portion of engagement pin 21 of link member 18 is slidably engaged with this spiral groove 25.

Spiral groove 25 has a diameter which decreases in the rotational direction of timing sprocket 11. Spiral groove 25 has a constant rate of change in the entirety. When spiral disc 23 is relatively pivoted in the retard direction with respect to the timing sprocket 11 in a state in which each of engagement pins 21 is engaged with spiral groove 25, the second end portion of link member 18 is introduced by radial window hole 17 and also the spiral shape of spiral groove 25, and moved radially inwards (in the advance direction). Contrary, when spiral disc 23 is relatively moved in the advance direction, the second end portion of link member 18 is moved radially outwards, and engagement pin 21 is controlled to the most retarded position in the state in which the engagement pin 21 is positioned in the bending portion of winding groove 25.

When engagement pin 21 is positioned in a groove end region on the most outer circumference portion of spiral groove 25, VTC 10 is controlled to a position which is slightly in the advance direction, and which is appropriate to the start of the engine.

When spiral disc 23 receives the relative manipulation force with respect to cam shaft 1, the second end portion of link member 18 is moved in the radial direction within each radial window hole 17 through each spiral groove 25 and the end portion of each engagement pin 21 by the manipulation force. In this case, the relative pivot force is transmitted to timing sprocket 11 and driven shaft member 14 by the operation (movement) of link member 18.

Electromagnetic brake mechanism 13 includes a torsion spring 26 arranged to urge spiral disc 23 in the rotational direction (the advance direction) of timing sprocket 11; and a hysteresis brake 27 which is an electromagnetic actuator arranged to brake spiral disc 23 in a direction opposite to the rotational direction (the retard direction) of timing sprocket 11. The braking force of hysteresis brake 27 is controlled by the current outputted from ECU 3 in accordance with the operating state of the engine. Consequently, spiral disc 23 is relatively pivoted with respect to timing sprocket 11, or the pivot position of spiral disc 23 and timing sprocket 11 are held.

Hysteresis brake 27 includes a nonmagnetic annular plate 24 fixed on the front end portion of spiral disc 23 through a connection pin 31; a hysteresis ring 28 fixed on a front end surface of annular plate 24; an annular coil yoke 29 disposed on a front end portion of hysteresis ring 28; and an electromagnetic coil 30 received within coil yoke 29, and arranged to introduce magnetism (magnetic flux) to coil yoke 29.

Electromagnetic coil 30 is arranged to generate the brake torque to hysteresis ring 28 by the magnetic force generated through coil yoke 29 when ECU 3 performs the duty control of electromagnetic coil 30 by the energization. That is, when hysteresis ring 28 is moved within the magnetic field between pole teeth 32 and 33 by the energization to electromagnetic coil 30, the braking torque is generated by the deviation between the direction of the magnetic field and the direction of the magnetic flux within hysteresis ring 28. The braking force is not related to the rotational speed of hysteresis ring 28 (the relative speed between confronting inner and outer circumference surfaces and hysteresis ring 28). The braking force becomes a constant value substantially proportional to the magnitude of the magnetic field, that is, the magnitude of the exciting current of electromagnetic coil 30.

Phase varying mechanism 12 includes radial window holes 17 of timing sprocket 11, link members 18, engagement pins 21, spiral disc 23, and spiral groove 25.

ECU 3 is configured to calculate the rotational phase of timing sprocket 11 and cam shaft 1 by reference crank angle signal REF and unit angle signal POS of crank angle sensor 5, and reference cam angle signal CAM of cam angle sensor 6.

Figure 4A:
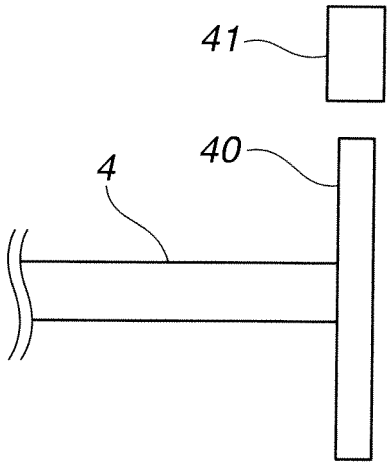
FIG. 4A is a side view showing a crank angle sensor of the valve timing control apparatus of FIG. 2.
Figure 4B:
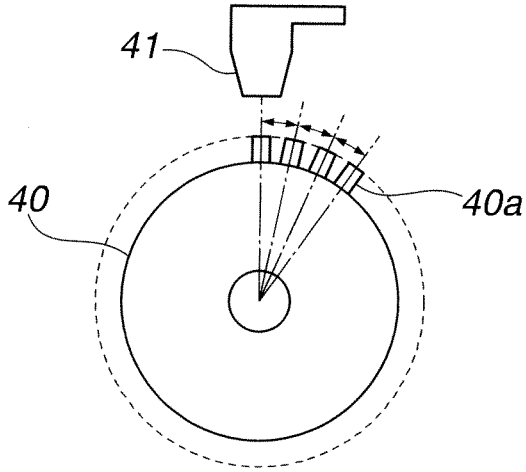
FIG. 4B is a front view showing the crank angle sensor of FIG. 4A.

Crank angle sensor 5 is a general or normal one. As shown in FIGS. 4A and 4B, crank angle sensor 5 includes a crank disc 40 coaxially attached to the end portion of crank shaft 4; and a crank vicinity sensor 41. Crank disc 40 includes targets 40*a* arranged at substantially regular intervals for sensing the rotation of crank shaft 4. Crank vicinity sensor 41 senses these targets 40*a* to obtain unit angle signal (rotational angle) POS of crank shaft 4. Besides, reference crank angle signal REF is sensed at the reference rotational angle at the intervals of the crank angle of 90 degrees.

Figure 5A:
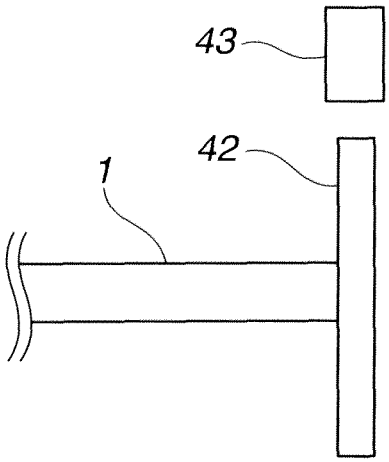
FIG. 5A is a side view showing a cam angle sensor of the valve timing control apparatus of FIG. 2.
Figure 5B:
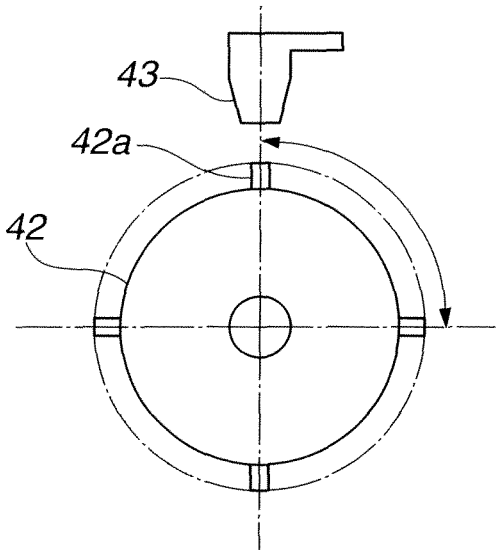
FIG. 5B is a front view showing the cam angle sensor of FIG. 5A.

Cam angle sensor 6 is a general or normal one. As shown in FIGS. 5A and 5B, cam angle sensor 6 includes a cam disc 42 coaxially attached to the end portion of cam shaft 1; and a cam vicinity sensor 43. Cam disc 42 includes targets 42*a* arranged at substantially regular intervals for sensing the rotation of cam shaft 1. The interval of adjacent two of targets 42*a* is determined so as to sense the rotation angle of cam shaft 1 which corresponds to the rotation of 180 degrees of crank shaft 4.

That is, in the in-line four cylinder engine, the interval is 90 degrees. In the V-type six cylinder engine, the interval is 120 degrees. Cam vicinity sensor 43 senses these targets 42*a*, and thereby obtains the reference cam angle signal CAM of cam shaft 1.

Figure 6:
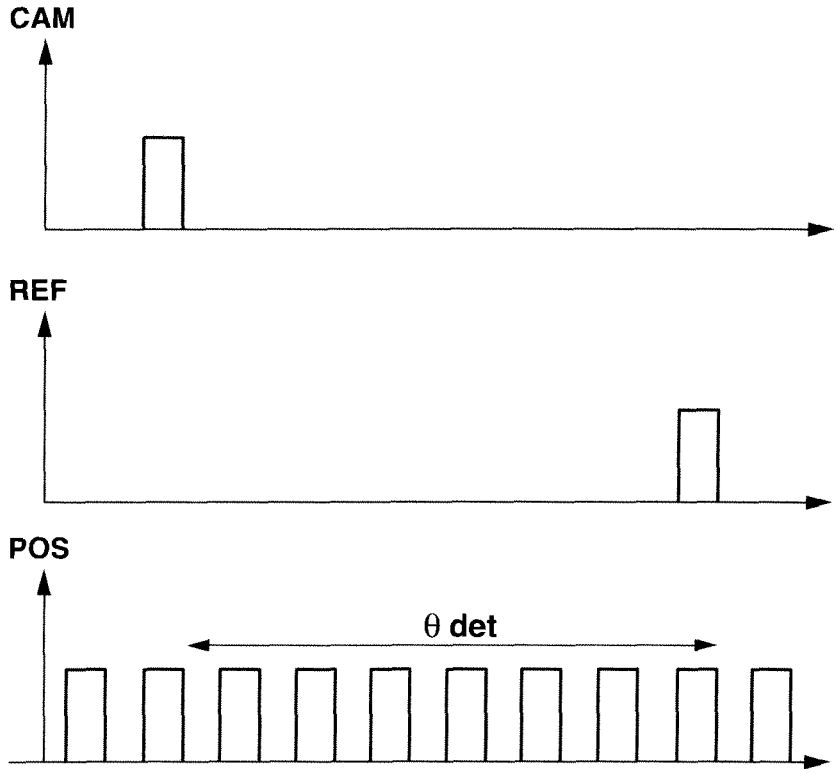
FIG. 6 is a view showing pulse signals obtained by the crank angle sensor and the cam angle sensor.

FIG. 6 is a timing chart showing the reference crank angle signal REF, the unit angle signal POS, and the reference cam angle signal CAM. ECU 10 is configured to sense a rotational phase θdet by counting the unit angle signal POS from a timing at which cam vicinity sensor 43 senses one of targets 42*a* and the reference cam angle signal CAM is renewed (updated), to a timing at which crank sensor 5 senses the reference crank angle signal REF.

Figure 7:
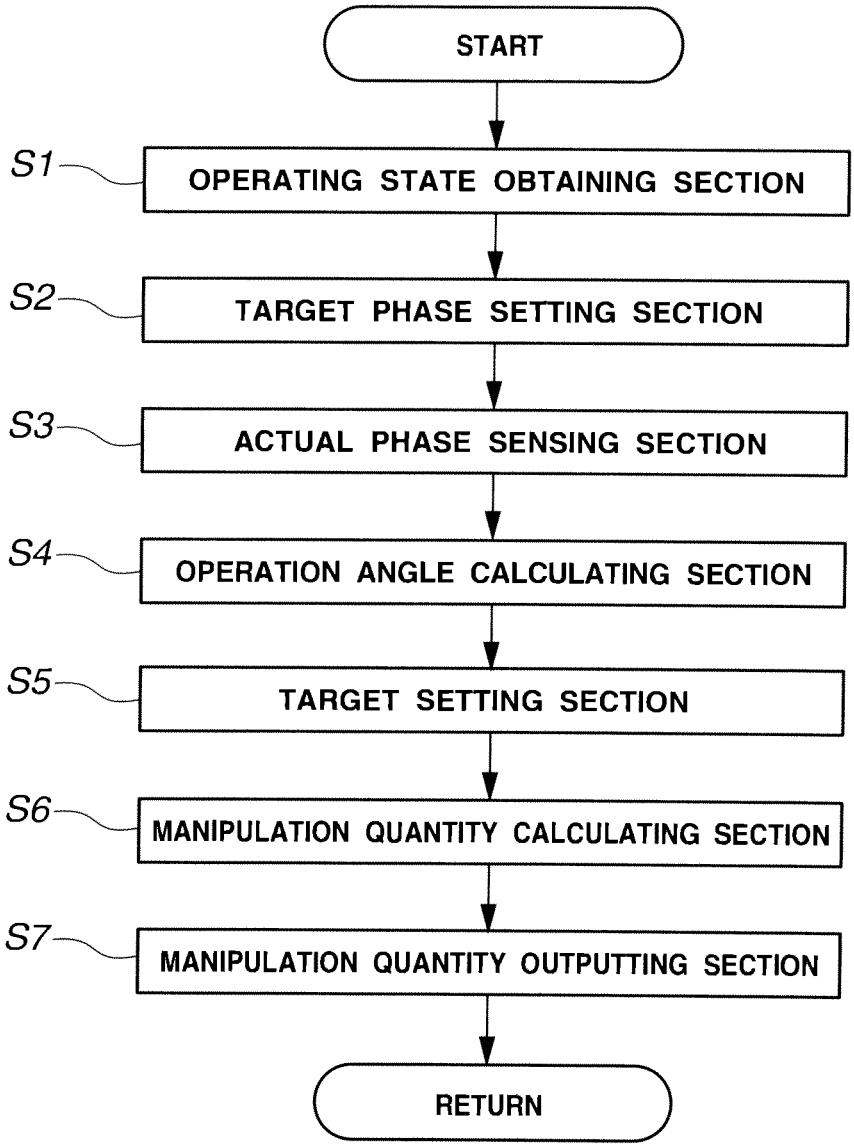
FIG. 7 is a block diagram showing a basic structure of an ECU of the valve timing control apparatus of FIG. 2.

As shown in FIG. 7, ECU 3 includes an operating state obtaining section S1 configured to obtain operating state information of the internal combustion engine; a target phase setting section S2 configured to set a normal target phase θtg1 of VTC 10 from the engine operating state obtained at operating state obtaining section S1; an actual phase sensing section S3 configured to sense an actual phase θdet of VTC 10; an operation angle calculating section S4 configured to calculate a magnitude θm of the phase angle that VTC 10 is operated (actuated), from normal target phase θtg1 obtained by target phase setting section S2 and actual phase θdet obtained by actual phase sensing section S3; a target setting section S5 configured to set a target phase variation pattern θtg in accordance with the magnitude of θm; a manipulation quantity calculating section S6 configured to calculate an manipulation quantity U based on a difference between target phase variation pattern θtg and actual phase θdet at a certain moment; and a manipulation quantity outputting section S7 configured to output voltage Vi based on manipulation quantity U calculated by manipulation quantity calculating section S6, to VTC 10.

It is optional to provide operating state obtaining section S1—manipulation quantity outputting section S7 as an electronic circuit independent from ECU 3. The rotational phase (valve timing) control shown in FIG. 6 starts when the ignition key is brought to the ON state. The rotational phase control is performed at intervals of a predetermined time (for example, 10 ms).

Figure 8:
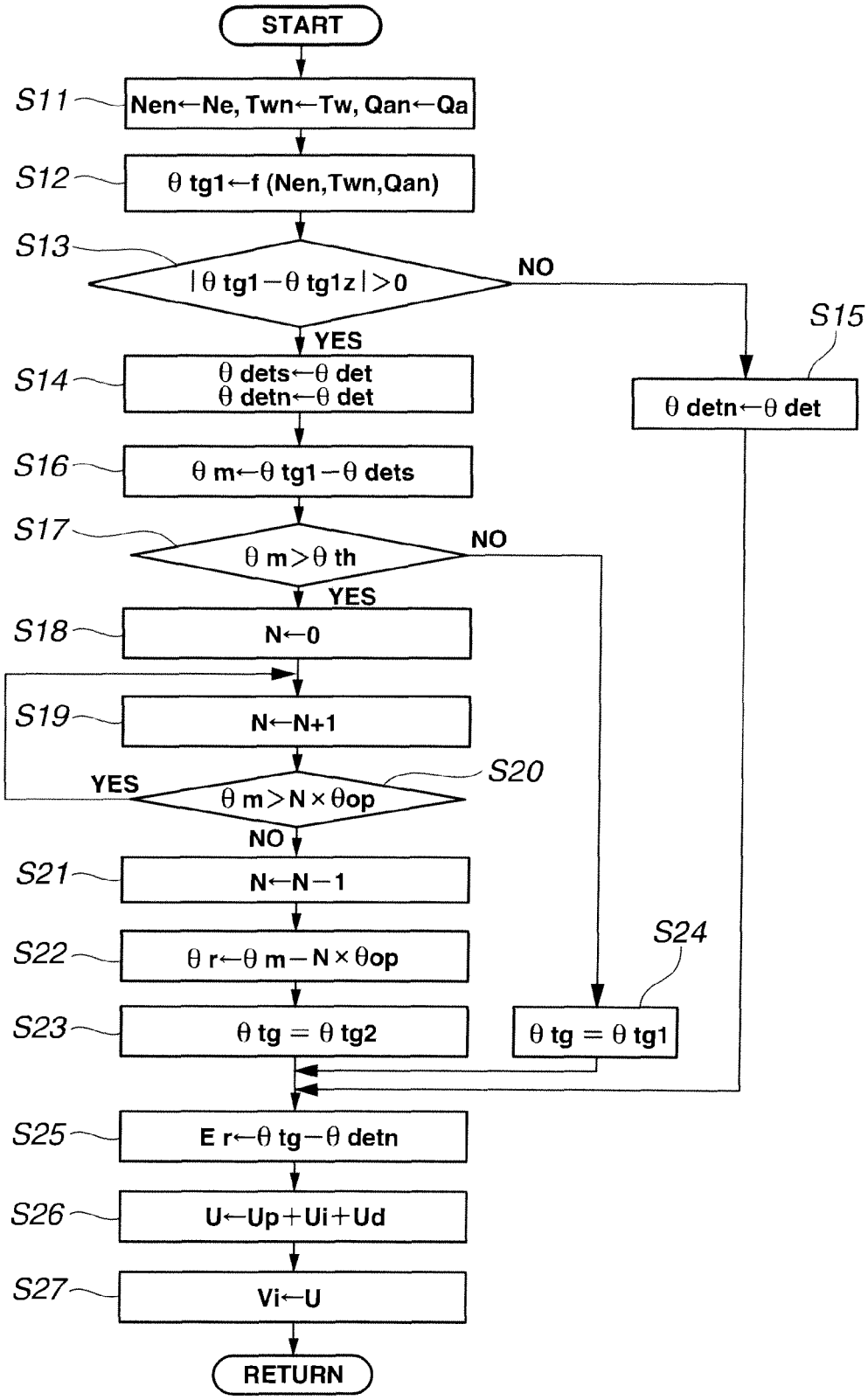
FIG. 8 is a flowchart showing a control process of the ECU of FIG. 2.

FIG. 8 is a flowchart showing a control process of VTC 10 by ECU 3. Operating state obtaining section S1 corresponds to step S11. Target phase setting section S2 corresponds to step S12. Actual phase sensing section S3 corresponds to steps S13-S15. Operation angle calculating section S4 corresponds to step S16. Target setting section S5 corresponds to steps S17-S24. Manipulation quantity calculating section S6 corresponds to steps S25-S26. Manipulation quantity outputting section S7 corresponds to step S27.

At step S11, operating state obtaining section S1 is configured to obtain the operating state information of the internal combustion engine such as engine speed Ne, cooling water temperature Tw, and intake air quantity Qa, by the sensors. In this case, the obtained information are substituted, respectively, to Nen, Twn and Qan.

At step S12, target phase setting section S2 is configured to set normal target phase (valve timing) θtg1 based on the operating state obtained at step S11. This normal target phase θtg1 is set with reference to a map of the target phase set in advance based on Ne, Tw, and index (intake air quantity) Qa showing the engine load.

In this embodiment, it is presumed that response time Tres of VTC 10 is shorter than a holding (continuing) time Tcon of the operating state Accordingly, a duration time Ttg1 of normal target phase θtg1 is longer than response time Tres. However, the present invention is applicable in a case in which response time Tres is longer than operating state holding time Tcon.

Actual phase sensing section S3 is configured to sense actual phase θdet by ECU 3 as described above, and to substitute actual phase θdet to θdetn at step S14. In this case, when a following mathematical expression 1 is satisfied, θdet is also substituted to θdets.

$$|\theta tg1-\theta tg1z|>0 \qquad \text{[Mathematical Expression 1]}$$

where θtg1$z$ is θtg1 at last (previous) time.

When the mathematical expression 1 is not satisfied, the process proceeds to step S15, and θdet is displaced by θdetn.

In the count of the time, the timing at which target phase angle θtg1 is varied is T=0.

Operation angle calculating section S4 is configured to calculate rotational phase angle (operation angle) θm that VTC 10 is acted (operated) actually, by ECU 3 by a following mathematical expression 2 at step S16.

$$\theta m=\theta tg1-\theta dets \qquad \text{[Mathematical Expression 2]}$$

Target setting section S5 is configured to set target phase variation pattern θtg (which is variable with respect to the time) that VTC 10 needs to follow, based on the operation angle θm by ECU 3.

Figure 9:
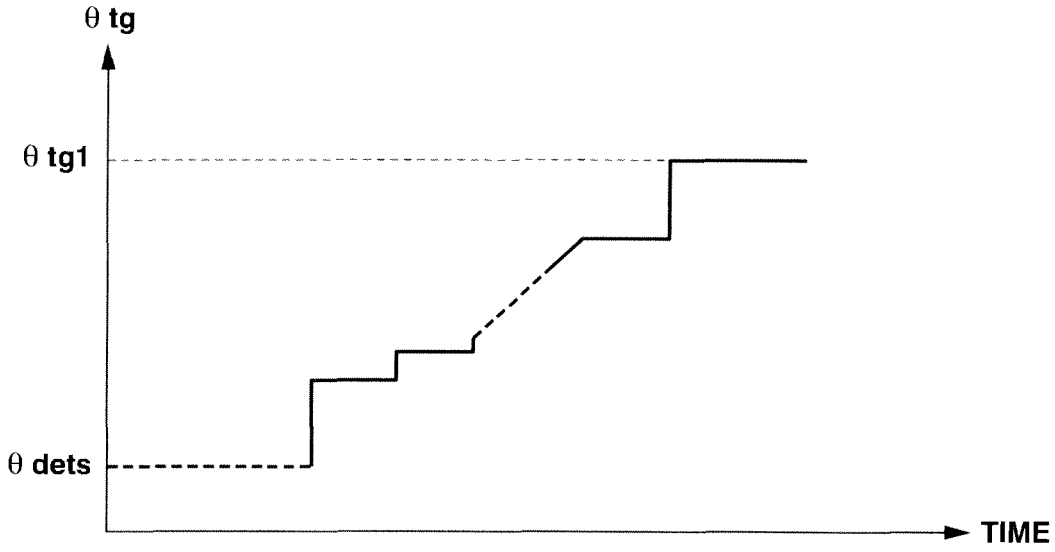
FIG. 9 is a characteristic view showing a pattern example in which a target phase is varied.

Target phase variation pattern θtg is a target value pattern that intermediate target phases are set between θdet and θtg1. For example, target phase variation pattern θtg becomes as shown in FIG. 9.

In this way, the intermediate target phases are set, and accordingly it is possible to suppress the overshoot of VTC 10 even in a case in which the operation angle is large and the overshoot tends to increase.

That is, at step S17, θm is compared with a threshold value θth. This threshold value θth is set in advance by an experiment and so on. This threshold value θth is set to a maximum operation angle that VTC 10 can perform a desired operation (movement), and that the overshoot falls within a desired magnitude.

$$\theta m>\theta th \qquad \text{[Mathematical Expression 3]}$$

When the mathematical expression 3 is not satisfied, θtg is set to θtg1 at step S24, as shown in a following mathematical expression 4. That is, θtg does not vary the target phase, and θtg becomes constant until θtg1 varies.

$$\theta tg=\theta tg1 \qquad \text{[Mathematical Expression 4]}$$

When the mathematical expression 3 is satisfied, target phase variation pattern θtg is set to θtg2 at steps S18-S23. At step S18, 0 is substituted into N. At step S19, N+1 is substituted into N, and the process proceeds to step S20.

At step S20, N×θop and θm are compared. When it is determined that θm is larger, the process returns to step S19. When it is determined that θm is smaller, the process proceeds to step S21.

At step S21, N−1 is substituted into N. At step S22, θm−N×θop is set to θr. Subsequently to step S22, θtg=θtg2 is set at step S23.

A mathematical expression 5 described later shows one example in which operation angle θm is divided in each fixed (specific) period Top with reference to one phase angle θop.

However, the present invention is not limited to this method. The time period for holding the intermediate target phases may be varied, for example, in each control period. It is optional that the holding time period of the intermediate target phases are not the identical fixed period. Moreover, it is not necessary that the intermediate target phases are divided with reference to the one phase angle. It is optional to set the phase angle difference between the intermediate targets, to arbitrary magnitude.

[Mathematical Expression 5]

$$\theta tg2=\begin{cases}\theta dets+\theta op(0\le Tn<Top)\\ \theta dets+2\times\theta op(Top\le Tn<2\times\mathrm{Top})\\ \vdots\\ \theta dets+N\times\theta op((N-1)\times Top\le Tn<N\times Top)\\ \theta dets+N\times\theta op+\theta r(N\times\mathrm{Top}\le Tn)\end{cases}$$

where N and θr are described later.

Top and θop are set in advance by experiment and analysis. In this embodiment, Top and θop are set so as not to overshoot, and set so as to converge to the target angle in the fastest manner as shown in a solid line of FIG. 10.

Accordingly, the phase of VTC 10 can be certainly moved in one (given) direction between θdets and θtg1.

Figure 10:
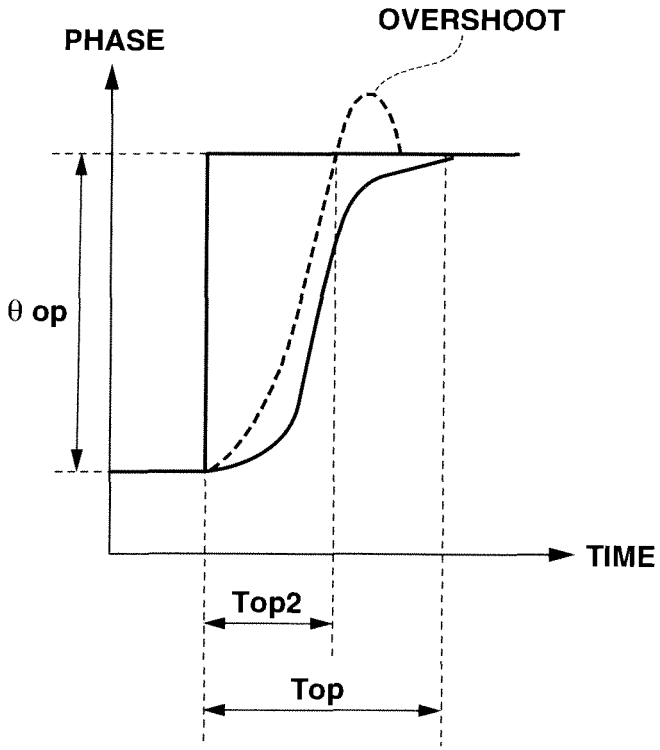
FIG. 10 is a characteristic view showing a target phase width and its duration which show an optimal response in the valve timing control apparatus of FIG. 2.

As shown in a broken line of FIG. 10, it is possible to set Top to the short period like Top2 so as to give priority to readiness or quick response of VTC 10 from θdets to θtg1, and so as to make the good response as a whole though the overshoot is caused.

N is a maximum value which is calculated at step S18-S21, and which satisfies a following mathematical expression 6.

$$\theta m > N \times \theta op \quad \text{[Mathematical Expression 6]}$$

Moreover, θr is a value calculated by a following mathematical expression 7 at step S22.

$$\theta r = \theta m - N \times \theta op \quad \text{[Mathematical Expression 7]}$$

Figure 12:
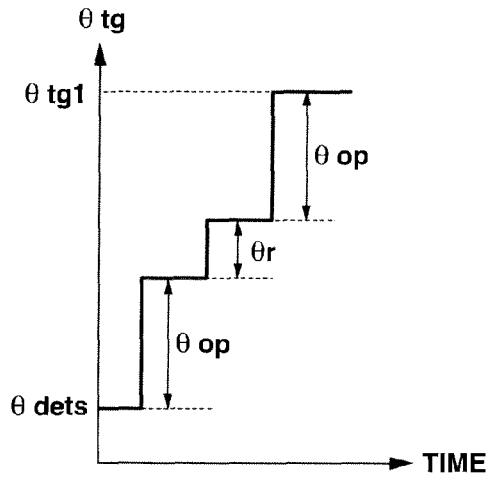
FIG. 12 is a characteristic view showing a second method of dividing the normal target phase by the width of the appropriate response.
Figure 13:
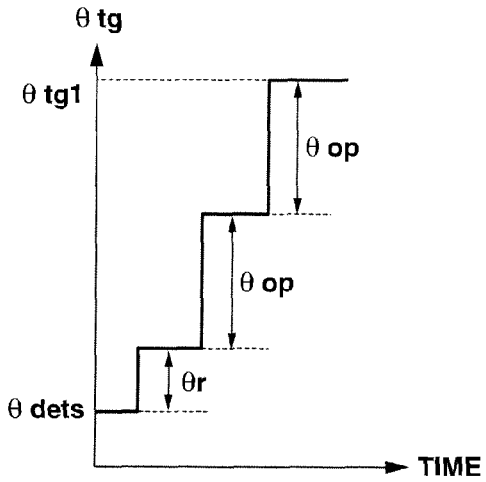
FIG. 13 is a characteristic view showing a first method of dividing the normal target phase by the width of the appropriate response.

Moreover, in the mathematical expression 5, θr is added to the target phase variation pattern at the last (at the end). The responsiveness of VTC 10 is varied by the adding order. For illustration, FIGS. 11-13 show examples of θtg1 when N is 2 and or is not 0.

Figure 11:
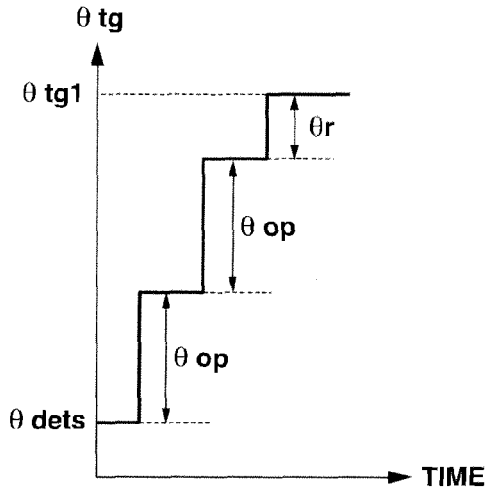
FIG. 11 is a characteristic view showing a first method of dividing a normal target phase by a width of an appropriate response.

FIG. 11 shows one example that θr is added at the last. That is, in the phase angle variation per unit time to repeat the increasing and decreasing of the current (duty ratio) applied to electromagnetic coil 30, θr which is added at the last to reach the target phase is smaller than the phase angle variation θop by which phase varying mechanism 12 starts to vary the phase, and approaches the target phase.

In this example, VTC 10 is moved θr at short time for the small operation angle at the last. Accordingly, it is possible to decrease the arrival time from θdets to θtg1.

In a case in which Top is set to Top2 so as to allow the overshoot to have the readiness (quick response), VTC 10 has a certain speed at an instant when the target phase is switched to θr. Accordingly, it is possible to further improve the readiness.

FIGS. 12 and 13 show examples in which θr is added at a timing other than the last. In the example shown in FIG. 12, θr added between the first and the last is minimized. In the example shown in FIG. 13, θr added at the first is minimized.

In this case, the response is arbitrarily set when θop is set. It is possible to set the convergence time to stationary error or the overshooting as the entirety from θdets to θdtg1.

At step S25, manipulation quantity calculating section S6 is configured to calculate the manipulation quantity U based on the difference between θtg and θdet. In this example, the PID control is performed. However, the control is not limited to the PID control.

That is, at step S25, difference Er between target phase variation pattern θtg and actual phase θdet is calculated.

$$Er = \theta tg - \theta detn \quad \text{[Mathematical Expression 8]}$$

At step S26, the manipulation quantity U is calculated by using Er by a following mathematical expression 9.

$$U = Up + Ui + Ud \quad \text{[Mathematical Expression 9]}$$

where Up, Ui and Ud are calculated by following mathematical expressions 10-12.

$$Up = Kp \times Er \quad \text{[Mathematical Expression 10]}$$

$$Ui = Ki \times Er + Uiz \quad \text{[Mathematical Expression 11]}$$

$$Ud = Kd \times (Er - Erz) \quad \text{[Mathematical Expression 12]}$$

where Uiz is Ui at last time (previous time), and Erz is Er at last time (previous time).

At step S27, manipulation quantity outputting section S7 is configured to output manipulation quantity U as input voltage Vi to VTC 10.

In this embodiment, θtg1 is larger than θdets for the assumption of the advance operation. However, the present invention is not limited to the advance operation. The present invention is applicable to the retard operation.

Second Embodiment

Figure 14:
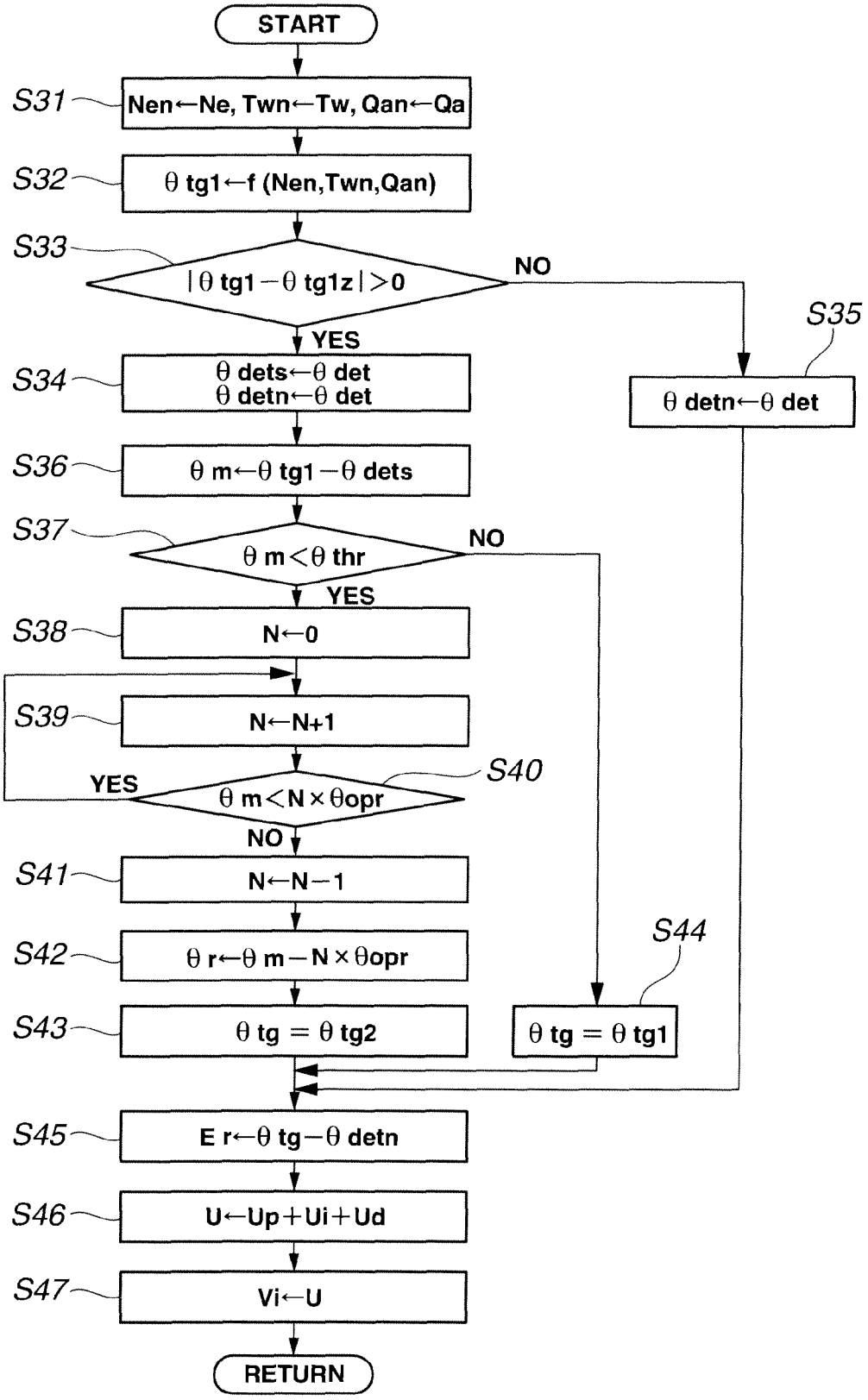
FIG. 14 is a flowchart showing a control process of an ECU in a variable valve control apparatus according to a second embodiment of the present invention.

FIG. 14 is a flowchart showing a control process of an ECU in a valve control apparatus according to a second embodiment of the present invention. This second embodiment is applied to the retard operation. As shown in FIG. 14, target setting section S5 is different from the first embodiment. More specifically, steps S17 and S20, the mathematical expressions 3, 5 and 6, threshold value θth, and θop are different. The other parts are identical to the first embodiment. The overlapping illustrations are omitted.

The setting of threshold value θthr, θopr and Topr will be illustrated. In the first embodiment, for the assumption of the advance operation, threshold value θth is equal to or greater than 0. In this second embodiment, the retard operation is assumed, operation angle threshold value θthr on the retard angle side is equal to or smaller than 0.

Figure 15:
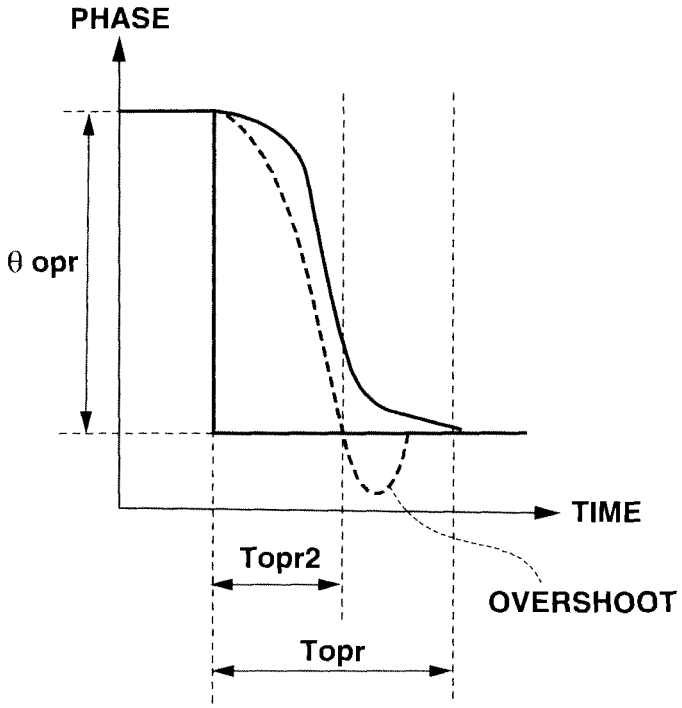
FIG. 15 is a characteristic view showing a target phase width and its duration which show an optimal response in the valve timing control apparatus according to the second embodiment.

Topr and θopr are set as appropriate step angle on the retard angle side, as a solid line shown in FIG. 15, like Top and θop. When Topr is set shorter as Topr2 so as to attain the good readiness (quick response) of VTC 10 from θdets to θotg1 as shown in the broken line of FIG. 15, the overshoot may be caused, and however the good response is attained as a whole.

The absolute value of operation angle threshold value θthr may be identical to threshold value θth, or be different value. The absolute value of θopr and Topr may be identical to values in the advance operation, or be different values.

In a case in which the operation characteristics of VTC 10 in the advance operation and in the retard operation are different from each other, the values in the advance operation and in the retard operation can be varied. Accordingly, it is possible to perform control appropriate for the operations.

In this embodiment, target setting section S5 which is different from the first embodiment, and which is applied to the retard direction is illustrated with reference to steps S37-S44 of FIG. 14.

At step S37, θm and θthr are compared with each other, and it is judged whether or not the target phase is varied. This is judged by a mathematical expression 13, like the mathematical expression 3 of step S17 of the first embodiment.

$$\theta m < \theta thr \quad \text{[Mathematical Expression 13]}$$

When the mathematical expression 13 is not satisfied, θtg is set to θtg1, like the first embodiment. When the mathematical expression 13 is satisfied, the target phase is varied. At steps S38-S41, θtg2 is set as shown in a following mathematical expression 14, like the mathematical expression 5 at steps S18-S23 of FIG. 8 of the first embodiment. The timing of adding θr is identical to the timing in the first embodiment.

[Mathematical Expression 14]

$$\theta tg2 = \begin{cases} \theta dets + \theta op(0 \le Tn < \text{Top}) \\ \theta dets + 2 \times \theta op(Top \le Tn < 2 \times \text{Top}) \\ \vdots \\ \theta dets + N \times \theta op((N-1) \times Top \le Tn < N \times Top) \\ \theta dets + N \times \theta op + \theta r(N \times \text{Top} \le Tn) \end{cases}$$

At steps S38-S43, N is determined, like steps S18-S23 of FIG. 8 of the first embodiment. In the first embodiment, the switching is performed as the mathematical expression 6 at step S20. However, in this embodiment, the switching is performed as a following mathematical expression 15 at step S40.

$$\theta m < N \times \theta op \quad \text{[Mathematical Expression 15]}$$

In the second embodiment for the retard operation, target setting section S5 sets θtg as described above, unlike the first embodiment. The other operations are identical to the operations of the first embodiment.

In the first and second embodiments, the target phase is varied only in one of the advance operation and the retard operation. It is optional to vary the target phase in both of the advance operation and the retard operation by combining the first and second embodiments.

As mentioned above, the concept of the present invention is to increase the driving force of VTC 10 immediately after the start of the operation, by dividing the target phase, and to decrease the driving force of VTC 10 at a timing to converge the target phase. Accordingly, it is possible to decrease the overshoot of VTC 10 without performing complex calculation, and without varying the control gain in the various conditions.

Figure 16:
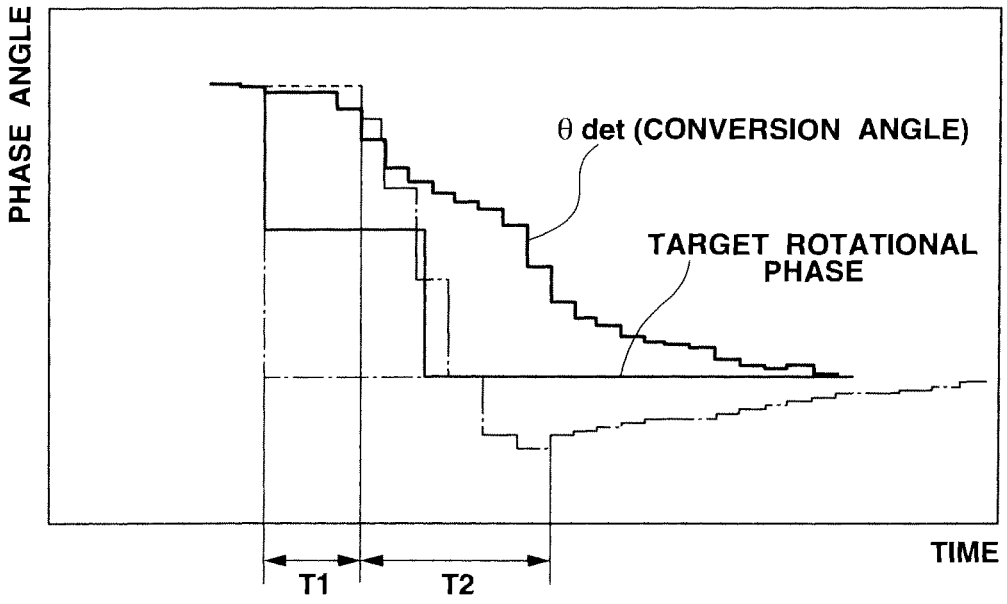
FIG. 16 is a characteristic view showing an operation response of the valve timing control apparatus according to the first and second embodiments of the present invention.

That is, in the conventional VTC, as shown in a dashed line of FIG. 16, the movement is slow for the influence of the sliding resistance during first fixed (specific) period T1 after the start of the operation. The movement is fast during the second fixed (specific) period T2. Consequently, the overshoot tends to generate at the operation of VTC 10.

In these embodiments of the present invention, in a case in which the target operation angle (variation quantity) is divided to, for example, two steps without varying the control gain, as shown in a solid line of FIG. 16, it is possible to ease the over-speed in the second half of the operation. Moreover, it is possible to suppress the overshoot.

Moreover, crank angle sensor 5 and cam angle sensor 6 which are phase angle sensing mechanism are not high accuracy, and are general (normal) ones. Accordingly, it is possible to suppress the increase of the cost.

The present invention is not limited to these embodiments. For example, the VTC may be provided on the exhaust valve side. It is optional to apply to a structure in which the phase varying mechanism is driven by an electromotive motor and so on without employing the electromagnetic brake of the valve timing control apparatus.

In the embodiments according to the present invention, a valve timing control apparatus for an internal combustion engine which is configured to control an opening timing or a closing timing of an intake valve or an exhaust valve, the valve timing control apparatus includes: a phase varying mechanism arranged to vary a relative rotational phase of a cam shaft with respect to a crank shaft; a driving mechanism arranged to provide a driving force to the phase varying mechanism by energization; a control mechanism configured to control a current applied to the driving mechanism; and a phase angle sensing mechanism arranged to sense the relative rotational phase of the cam shaft with respect to the crank shaft, and to have a detection period longer than a control period of the control mechanism in accordance with an engine operating state. The control mechanism is configured to repeat increasing and decreasing of the current applied to the driving mechanism when the phase varying mechanism continuously varies the relative rotational phase of the cam shaft with respect to the crank shaft by a predetermined angle or more.

In the embodiments according to the present invention, a valve timing control apparatus for an internal combustion engine which is configured to control an opening timing or a closing timing of an intake valve or an exhaust valve, the valve timing control apparatus includes: a phase varying mechanism arranged to vary a relative rotational phase of a cam shaft with respect to a crank shaft; a driving mechanism arranged to provide a driving force to the phase varying mechanism by energization; a control mechanism configured to perform a duty control of a current applied to the driving mechanism; and a phase angle sensing mechanism arranged to sense the relative rotational phase of the cam shaft with respect to the crank shaft, and to have a detection period longer than a control period of the control mechanism in accordance with an engine operating state. The control mechanism is configured to repeat increasing and decreasing of a duty ratio for the driving mechanism when the phase varying mechanism continuously varies the relative rotational phase of the cam shaft with respect to the crank shaft by a predetermined angle or more.

In the embodiments of the present invention, the valve timing control apparatus repeats to increase and decrease the duty ratio and the current applied to the driving mechanism from the control mechanism when the phase varying mechanism varies in series the relative rotational phase a predetermined angle or more. Accordingly, the driving force of VTC 10 is increased immediately after the start of the operation, and decreased at a timing to converge the target phase. Accordingly, it is possible to prevent the overshoot of VTC 10 without performing complex calculation, and without varying the control gain in the various conditions.

In the embodiments of the present invention, the general or normal crank angle sensor and the general or normal cam angle sensor are used. Accordingly, it is possible to suppress the increasing of the cost.

The entire contents of Japanese Patent Application No. 2008-37061 filed Feb. 19, 2008 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A valve timing control apparatus for an internal combustion engine which is configured to control an opening timing or a closing timing of an intake valve or an exhaust valve, the valve timing control apparatus comprising:

a phase varying mechanism arranged to vary a relative rotational phase of a cam shaft with respect to a crank shaft;

a driving mechanism arranged to provide a driving force to the phase varying mechanism by energization;

a control mechanism configured to control a current applied to the driving mechanism; and a phase angle sensing mechanism arranged to sense a relative rotational phase of the cam shaft with respect to the crank shaft, and to have a detection period longer than a control period of the control mechanism in accordance with an engine operating state, wherein, during operation, the control mechanism repeats increasing and decreasing of the current applied to the driving mechanism when the phase varying mechanism continuously varies the relative rotational phase of the cam shaft with respect to the crank shaft by at least a predetermined angle, and does not repeat increasing and decreasing of the current applied to the driving mechanism when the phase varying mechanism does not continuously vary the relative rotational phase of the cam shaft with respect to the crank shaft by at least the predetermined angle.

2. The valve timing control apparatus as claimed in claim 1, wherein, during operation, the control mechanism varies a phase angle variation per unit time to repeat the increasing and decreasing of the current applied to the driving mechanism.

3. The valve timing control apparatus as claimed in claim 2, wherein the phase angle variation per unit time includes a last variation to reach a target phase, which is smaller than a variation that the phase varying mechanism starts to vary the phase, and approaches the target phase.

4. The valve timing control apparatus as claimed in claim 2, wherein the phase angle variation per unit time includes a variation which is between a first variation that the phase varying mechanism starts to vary the phase, and a last variation to reach a target phase, and which is smaller than the first variation and the last variation.

5. The valve timing control apparatus as claimed in claim 2, wherein the phase angle variation per unit time includes a first variation that the phase varying mechanism starts to vary the phase, and that is smaller than a variation other than the first variation.

6. The valve timing control apparatus as claimed in claim 1, wherein a longest period of periods to repeat the increasing and decreasing of the current applied to the driving mechanism is a period in which the phase varying mechanism does not generate an overshoot.

7. The valve timing control apparatus as claimed in claim 1, wherein, during operation, the control mechanism sets a target value of a phase angle varied by the phase varying mechanism from the engine operating state, calculates an actual phase of the cam shaft with respect to the crank shaft, determines a phase angle for a movement from the actual phase to the target value, and sets a period to repeat the increasing and decreasing of the current applied to the driving mechanism when the phase angle for the movement from the actual phase to the target value is equal to or greater than a predetermined angle.

8. The valve timing control apparatus as claimed in claim 1, wherein the driving mechanism is arranged to provide the driving force to the phase varying mechanism by directly providing, to the phase varying mechanism, an electromagnetic force generated by the energization.

9. The valve timing control apparatus as claimed in claim 8, wherein the driving mechanism is an electromagnetic brake mechanism.

10. The valve timing control apparatus as claimed in claim 8, wherein the driving mechanism is an electromotive motor.

11. A valve timing control apparatus for an internal combustion engine which is configured to control an opening timing or a closing timing of an intake valve or an exhaust valve, the valve timing control apparatus comprising:

a phase varying mechanism arranged to vary a relative rotational phase of a cam shaft with respect to a crank shaft;

a driving mechanism arranged to provide a driving force to the phase varying mechanism by energization;

a control mechanism configured to perform a duty control of a current applied to the driving mechanism; and a phase angle sensing mechanism arranged to sense a relative rotational phase of the cam shaft with respect to the crank shaft, and to have a detection period longer than a control period of the control mechanism in accordance with an engine operating state, wherein, during operation, the control mechanism repeats increasing and decreasing of a duty ratio for the driving mechanism when the phase varying mechanism continuously varies the relative rotational phase of the cam shaft with respect to the crank shaft by at least a predetermined angle, and does not repeat increasing and decreasing of a duty ratio for the driving mechanism when the phase varying mechanism does not continuously vary the relative rotational phase of the cam shaft with respect to the crank shaft by at least the predetermined angle.

12. The valve timing control apparatus as claimed in claim 11, wherein, during operation, the control mechanism varies a phase angle variation per unit time to repeat the increasing and decreasing of the duty ratio.

13. The valve timing control apparatus as claimed in claim 12, wherein the phase angle variation per unit time includes a last variation to reach a target phase, which is smaller than a variation that the phase varying mechanism starts to vary the phase, and approaches the target phase.

14. The valve timing control apparatus as claimed in claim 12, wherein the phase angle variation per unit time includes a variation which is between a first variation that the phase varying mechanism starts to vary the phase, and a last variation to reach a target phase, and which is smaller than the first variation and the last variation.

15. The valve timing control apparatus as claimed in claim 12, wherein the phase angle variation per unit time includes a first variation that the phase varying mechanism starts to vary the phase, and that is smaller than a variation other than the first variation.

16. The valve timing control apparatus as claimed in claim 11, wherein a longest period of periods to repeat the increasing and decreasing of the duty ratio is a period in which the phase varying mechanism does not generate an overshoot.

17. The valve timing control apparatus as claimed in claim 11, wherein, during operation, the control mechanism sets a target value of a phase angle varied by the phase varying mechanism from the engine operating state, calculates actual phase of the cam shaft with respect to the crank shaft, determines a phase angle for a movement from the actual phase to the target value, and sets a period to repeat the increasing and decreasing of the duty ratio when the phase angle for the movement from the actual phase to the target value is equal to or greater than a predetermined angle.

18. The valve timing control apparatus as claimed in claim 11, wherein the driving mechanism is arranged to provide the driving force to the phase varying mechanism by directly providing, to the phase varying mechanism, an electromagnetic force generated by the energization.

19. A valve timing control apparatus for an internal combustion engine which is configured to control an opening timing or a closing timing of an intake valve or an exhaust valve, the valve timing control apparatus comprising:

a phase varying mechanism arranged to vary a relative rotational phase of a cam shaft with respect to a crank shaft;

a driving mechanism arranged to provide a driving force to the phase varying mechanism by energization;

a control mechanism configured to control a current applied to the driving mechanism; and a phase angle sensing mechanism arranged to sense a relative rotational phase of the cam shaft with respect to the crank shaft, and to have a detection period longer than a control period of the control mechanism in accordance with an engine operating state, wherein, during operation, the phase varying mechanism repeats increasing and decreasing of a movement speed when the phase varying mechanism continuously varies the relative rotational phase of the cam shaft with respect to the crank shaft by at least a predetermined angle, and does not repeat increasing and decreasing of a movement speed when the phase varying mechanism does not continuously vary the relative rotational phase of the cam shaft with respect to the crank shaft by at least the predetermined angle.

20. The valve timing control apparatus as claimed in claim 19, wherein, during operation, the driving mechanism repeats increasing and decreasing of the driving force when the phase varying mechanism continuously varies the relative rotational phase of the cam shaft with respect to the crank shaft by at least the predetermined angle.

21. A valve timing control apparatus for an internal combustion engine that is configured to control an opening timing or a closing timing of an intake valve or an exhaust valve, the valve timing control apparatus comprising:

a phase varying mechanism configured to vary a relative rotational phase angle of a cam shaft with respect to a crank shaft;

a driving mechanism configured to provide a driving force to the phase varying mechanism;

a control mechanism configured to control a current applied to the driving mechanism; and a phase angle sensing mechanism configured to sense an actual relative rotational phase angle of the cam shaft with respect to the crank shaft, wherein, to reach a target relative rotational phase angle during operation, the control mechanism (i) performs a plurality of modifications of the current applied to the driving mechanism when a difference between the target relative rotational phase and the actual relative rotational phase angle is greater than a threshold angle, and (ii) performs a single modification of the current applied to the driving mechanism when a difference between the target relative rotational phase angle and the actual relative rotational phase angle is less than the threshold angle.

* * * * *